US007077509B2

(12) United States Patent
Parish et al.

(10) Patent No.: US 7,077,509 B2
(45) Date of Patent: Jul. 18, 2006

(54) INKJET PRINTHEAD HEATER CHIP WITH ASYMMETRIC INK VIAS

(75) Inventors: George Keith Parish, Winchester, KY (US); Kristi Maggard Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/946,679

(22) Filed: Sep. 22, 2004

(65) Prior Publication Data

US 2005/0041071 A1 Feb. 24, 2005

Related U.S. Application Data

(62) Division of application No. 10/334,157, filed on Dec. 30, 2002, now Pat. No. 6,863,381.

(51) Int. Cl.
*B41J 2/05* (2006.01)
*B41J 2/21* (2006.01)

(52) U.S. Cl. ..... 347/63; 347/43

(58) Field of Classification Search ..... 347/20, 347/56, 61–65, 67, 15, 43
See application file for complete search history.

(56) References Cited

U.S. PATENT DOCUMENTS 5,030,971 A * 7/1991 Drake et al. ..... 347/57
5,211,806 A * 5/1993 Wong et al. ..... 347/63

* cited by examiner

*Primary Examiner*—Juanita D. Stephens
(74) *Attorney, Agent, or Firm*—King & Schickli, PLLC

(57) ABSTRACT

An inkjet printhead heater chip has an ink via asymmetrically arranged in a reciprocating direction of inkjet printhead movement. The ink via has two sides and a longitudinal extent substantially parallel to a print medium advance direction. A column of fluid firing elements exists exclusively along a single side of the two sides. The heater chip and ink via each have a centroid and neither resides coincidentally with one another. Preferably, the heater chip centroid resides externally to a boundary of the ink via. In other aspects, the column of fluid firing elements can be a sole column or plural and may be centered in the reciprocating direction. The ink via can be a sole via or plural. The heater chip can be rectangular and the ink vias can be closer to either the long or short ends thereof. Inkjet printers for housing the printheads are also disclosed.

21 Claims, 7 Drawing Sheets

INKJET PRINTHEAD HEATER CHIP WITH ASYMMETRIC INK VIAS

This application is a Divisional Application of U.S. patent application Ser. No. 10/334,157, now U.S. Pat. No. 6,863, 381, filed on Dec. 30, 2002 entitled "Inkjet Printhead Heater Chip With Asymmetric Ink Vias.

FIELD OF THE INVENTION

The present invention relates to inkjet printheads. In particular, it relates to a heater chip thereof having asymmetrically arranged ink vias that yield silicon savings.

BACKGROUND OF THE INVENTION

The art of printing images with inkjet technology is relatively well known. In general, an image is produced by emitting ink drops from an inkjet printhead at precise moments such that they impact a print medium at a desired location. The printhead is supported by a movable print carriage within a device, such as an inkjet printer, and is caused to reciprocate relative to an advancing print medium and emit ink drops at such times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, to name a few.

Conventionally, a thermal inkjet printhead includes access to a local or remote supply of color or mono ink, a heater chip, a nozzle or orifice plate attached to the heater chip, and an input/output connector, such as a tape automated bond (TAB) circuit, for electrically connecting the heater chip to the printer during use. The heater chip, in turn, typically includes a plurality of thin film resistors or heaters fabricated by deposition, masking and etching techniques on a substrate such as silicon. One or more ink vias cut or etched through a thickness of the silicon serve to fluidly connect the supply of ink to the individual heaters.

To print or emit a single drop of ink, an individual resistive heater is uniquely addressed with a small amount of current to rapidly heat a small volume of ink. This causes the ink to vaporize in a local ink chamber (between the heater and nozzle plate) and be ejected through and projected by the nozzle plate towards the print medium.

In the past, manufacturers typically configured their heater chips with a centrally disposed elongate ink via(s) with attendant heaters on both sides thereof. Recently, as heater chips have become smaller and more densely packed with heaters, some ink vias have only had heaters disposed along a single side thereof. Such designs, however, have maintained their ink via(s) in a central disposition which leads to chip silicon waste. For example, consider the heater chip 725 of FIG. 7A with a single elongate ink via 732, centrally disposed (+), such that about 1000 microns of silicon (in a direction transverse to the elongate extent of the ink via) exist on both sides thereof. If the heater chip has columnar-disposed bond pads 728 near chip edges that parallel heater columns 734-L, 734-R on both sides of the ink via, the chip has fixed distances d1, d2 between the heater columns and bond pads. To wipe the nozzles above the heaters during printhead maintenance routines, a wiper (not shown) sweeps across a surface of the nozzles but, for printhead longevity reasons, does not sweep across the bond pads. Thus, since printers have wipers mechanically and electrically connected to motors and other structures in a manner such that the wipers have fixed times of lowering, raising and traveling, the printheads, in turn, require distances d1, d2 to have some minimum length to effectively wipe the nozzles while avoiding the bond pads.

Now consider the heater chip of FIG. 7B having eliminated the right columnar heaters shown in FIG. 7A, perhaps by more densely packing heaters into column 734-L. If the ink via 732 remains centrally disposed (+) on the chip, wasted silicon space results because wiping is no longer required to the right of the ink via (and no minimum distance is required) yet the distance from the center of the via to the chip periphery 741 remains the same. Keep in mind, the chips 725 of FIGS. 7A, 7B have been greatly simplified and often include additional ink vias and heaters.

Accordingly, the inkjet printhead arts desire heater chips having optimally arranged ink via(s) that minimize silicon costs.

SUMMARY OF THE INVENTION

The above-mentioned and other problems become solved by applying the principles and teachings associated with the hereinafter described inkjet printhead heater chip having asymmetric ink vias.

In one embodiment, an inkjet printhead heater chip has an ink via asymmetrically arranged in a reciprocating direction of inkjet printhead movement. The ink via has two sides and a longitudinal extent substantially parallel to a print medium advance direction. A column of fluid firing elements exists exclusively along a single side of the two sides. The heater chip and ink via each have a centroid and neither resides coincidentally with one another. Preferably, the heater chip centroid resides externally to a boundary of the ink via. It one embodiment, it resides between the column of fluid firing elements and one of the two sides of the ink via. In another embodiment, the column of fluid firing elements passes through the centroid. A column of input terminals on the heater chip communicate electrically with an inkjet printer and exist in parallel with the column of fluid firing elements. In a preferred embodiment, about 880 microns of lateral distance separate the two columns while about 600 microns separate the side of the ink via opposite the column of fluid firing elements and a periphery of the heater chip. In addition, the heater chip may include other vertically, horizontally or angularly disposed ink vias with columns of fluid firing elements on either one or two sides thereof. The ink vias reside in a thickness of the heater chip and fluidly connect to a supply of ink in the inkjet printhead.

Vertically adjacent fluid firing elements of the column of fluid firing elements may or may not have a horizontal separation gap there between. Preferred pitch of the fluid firing elements ranges from about $1/300^{th}$ to about $1/2400^{th}$ of an inch. The fluid firing elements may embody thermally resistive heater elements formed as thin film layers on a silicon substrate or piezoelectric elements despite the thermal technology implication derived from the name heater chip.

In another aspect of the invention, the column of fluid firing elements is substantially centered in the reciprocating direction.

In still another aspect, the heater chip has a sole column of fluid firing elements and a sole ink via.

Printheads containing the heater chip and printers containing the printhead are also disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the invention may be practiced. These embodiments are described in sufficient detail to enable those skilled in the art to practice the invention and it is to be understood that other embodiments may be utilized with various process, electrical, mechanical, chemical, or other changes without departing from the scope of the present invention. The following detailed description is, therefore, not to be taken in a limiting sense and the scope of the present invention is defined only by the appended claims and their equivalents. In accordance with the present invention, we hereinafter describe an inkjet printhead heater chip having asymmetrically arranged ink vias.

Figure 1:
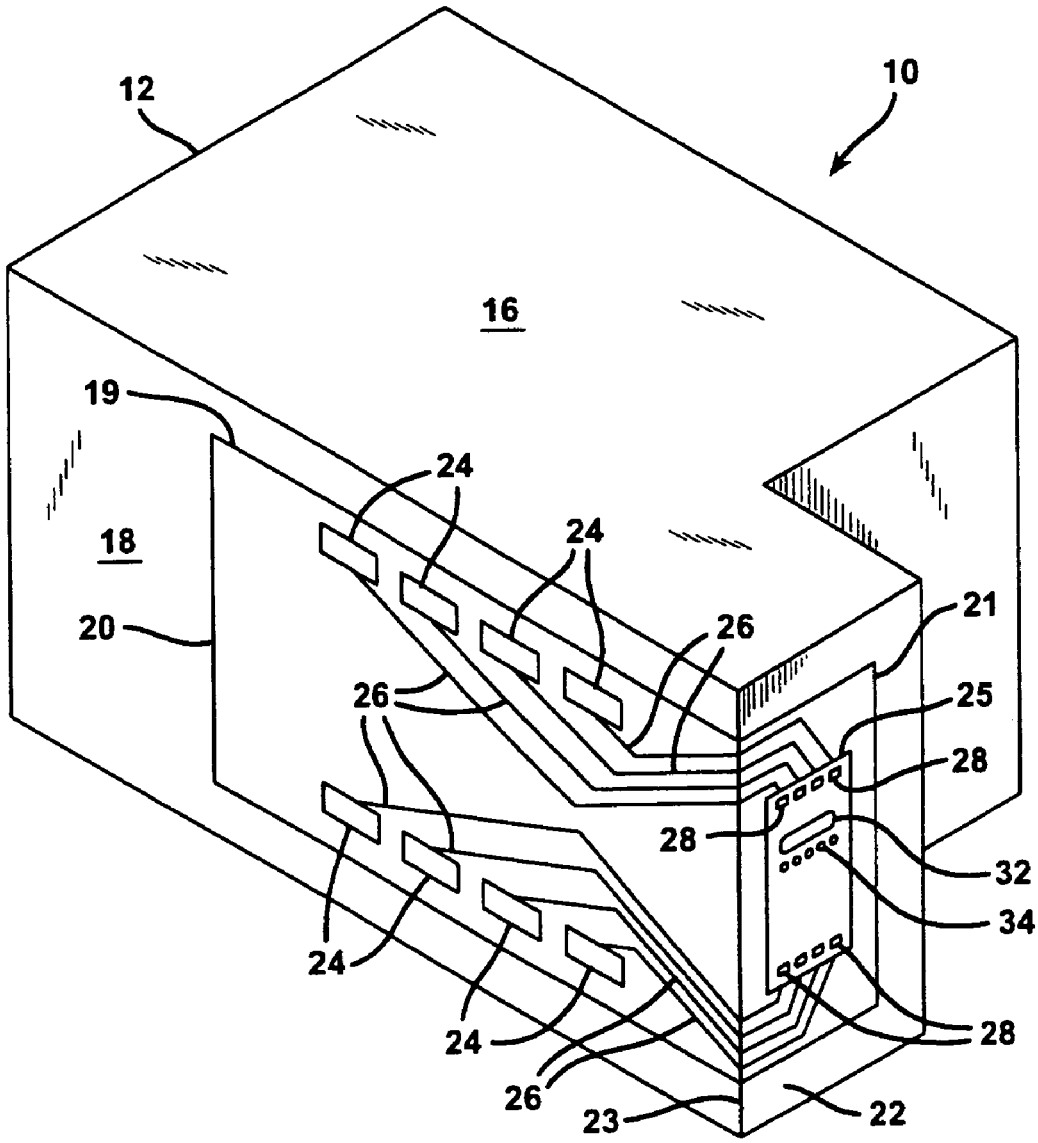
FIG. 1 is a perspective view in accordance with the teachings of the present invention of a thermal inkjet printhead having a heater chip with an asymmetric ink via.

With reference to FIG. 1, an inkjet printhead of the present invention is shown generally as 10. The printhead 10 has a housing 12 formed of any suitable material for holding ink. Its shape can vary and often depends upon the external device that carries or contains the printhead. The housing has at least one compartment 16 internal thereto for holding an initial or refillable supply of ink. In one embodiment, the compartment has a single chamber and holds a supply of black ink, photo ink, cyan ink, magenta ink or yellow ink. In other embodiments, the compartment has multiple chambers and contains three supplies of ink. Preferably, it includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply from a tube, for example.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 thereon for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Those skilled in the art know various techniques for facilitating such connections. For simplicity, FIG. 1 only shows eight I/O connectors 24, eight electrical conductors 26 and eight bond pads 28 but present day printheads have much larger quantities and any number is equally embraced herein. Still further, those skilled in the art should appreciate that while such number of connectors, conductors and bond pads equal one another, actual printheads may have unequal numbers.

The heater chip 25 contains a column 34 of a plurality of fluid firing elements that serve to eject ink from compartment 16 during use. The fluid firing elements may embody thermally resistive heater elements (heaters for short) formed as thin film layers on a silicon substrate or piezoelectric elements despite the thermal technology implication derived from the name heater chip. For simplicity, the pluralities of fluid firing elements in column 34 are shown adjacent an ink via 32 as a row of five dots but in practice may include several hundred or thousand fluid firing elements. As described below, vertically adjacent ones of the fluid firing elements may or may not have a lateral spacing gap or stagger there between. In general, the fluid firing elements have vertical pitch spacing comparable to the dots-per-inch resolution of an attendant printer. Some examples include spacing of $1/300^{th}$, $1/600^{th}$, $1/1200^{th}$, $1/2400^{th}$ or other of an inch along the longitudinal extent of the via. To form the vias, many processes are known that cut or etch the via 32 through a thickness of the heater chip. Some of the more preferred processes include grit blasting or etching, such as wet, dry, reactive-ion-etching, deep reactive-ion-etching, or other. A nozzle plate (not shown) has orifices thereof aligned with each of the heaters to project the ink during use. The nozzle plate may attach with an adhesive or epoxy or may be fabricated as a silicon thin-film layer.

Figure 2:
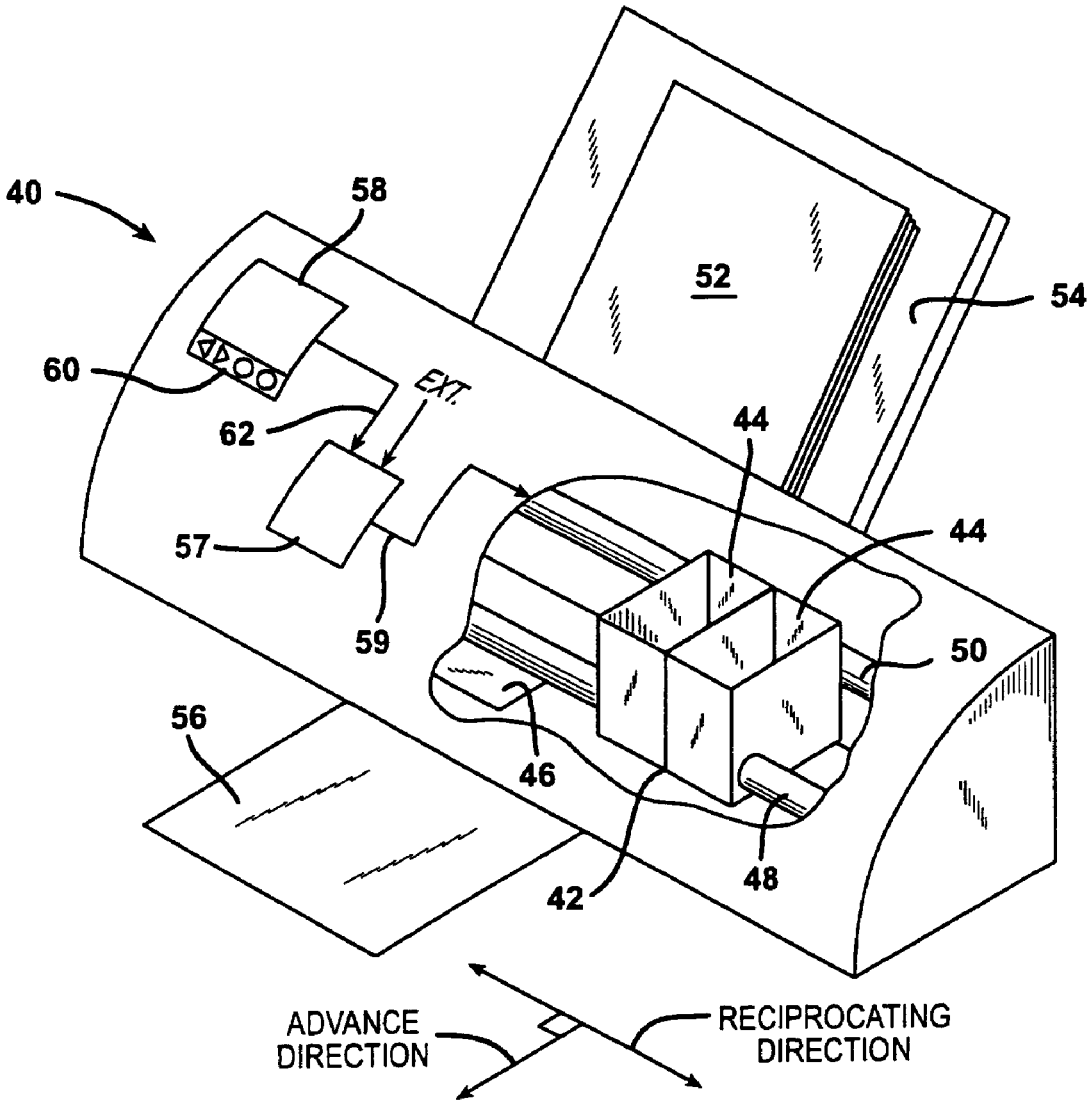
FIG. 2 is a perspective view in accordance with the teachings of the present invention of an inkjet printer.

With reference to FIG. 2, an external device in the form of an inkjet printer for containing the printhead 10 is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50 as is well known in the art. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be eject from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer and include, but are not limited to, a computer, a scanner, a camera, a visual display unit, a personal data assistant, or other.

To print or emit a single drop of ink, the fluid firing elements (the dots of column 34, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

Figure 3:
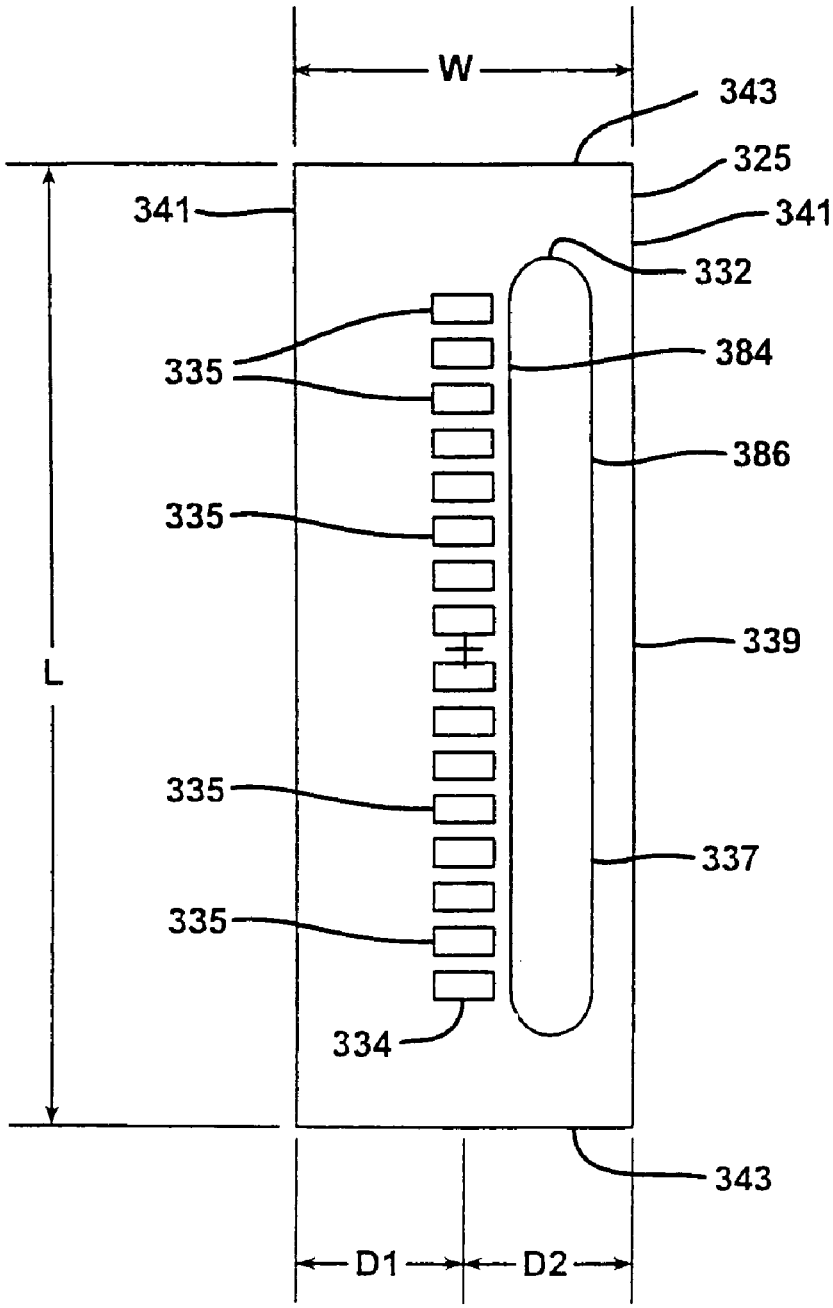
FIG. 3 is a diagrammatic view in accordance with the teachings of the present invention of a heater chip with a widthwise asymmetrically disposed ink via.

With reference to FIG. 3, a heater chip 325 of one embodiment of the present invention has a sole ink via 332 with a longitudinal extent defined by two sides 384, 386. A sole column 334 of a plurality of fluid firing elements 335 exists exclusively along one of the two sides of the ink via.

A chip centroid (+) resides within the sole column 334 external to a boundary 337 of the ink via. A via centroid (•) is substantially offset from the chip centroid in the widthwise direction w such that the two centroids do not coexist. In this manner, the heater chip has an asymmetrically disposed ink via and silicon space on a side of the ink via not containing any fluid firing elements is no longer wasted. In a preferred embodiment, a straight line distance between the chip centroid and the via centroid is about 150 microns. Still further, a distance from the side 386 to a periphery 339 of the heater chip is about 600 microns which offers about 100 to 300 microns of silicon savings over the prior art.

In another embodiment, the column of fluid firing elements exists substantially centered in the widthwise direction w of the heater chip such that distance D1 is substantially equidistant to distance D2. As oriented on an inkjet printhead in an inkjet printer during use, widthwise direction w corresponds to the Reciprocating Direction of FIG. 2. Thus, the sole ink via 332 is thereby asymmetrically arranged in the Reciprocating Direction.

Under modern wafer dicing practices, an individual heater chip diced from a larger multi-chip wafer will likely embody a rectangular shape in its largest surface area and have two long 341 and short 343 ends as shown. A representative lengthwise distance L of the heater chip is about 17 millimeters (mm) while the widthwise distance w is about 3 mm.

It will be appreciated that the present invention contemplates other heater chip geometric shapes such as ovals, circles, squares, triangles, polygons or other shapes lending themselves to symmetrical or asymmetrical peripheries or regular or irregular boundaries. To calculate the chip centroid, well known standard formulas are used. Since the heater chip itself is a three-dimensional (3-D) object, the chip centroid for purposes of this invention can either correspond to the chip centroid of the actual 3-D object or the 2-D figure shown diagrammatically. Likewise, the calculation of the via centroids are governed by standard formulas and may either correspond to the actual 3-D object or the 2-D figure representation.

Figure 4:
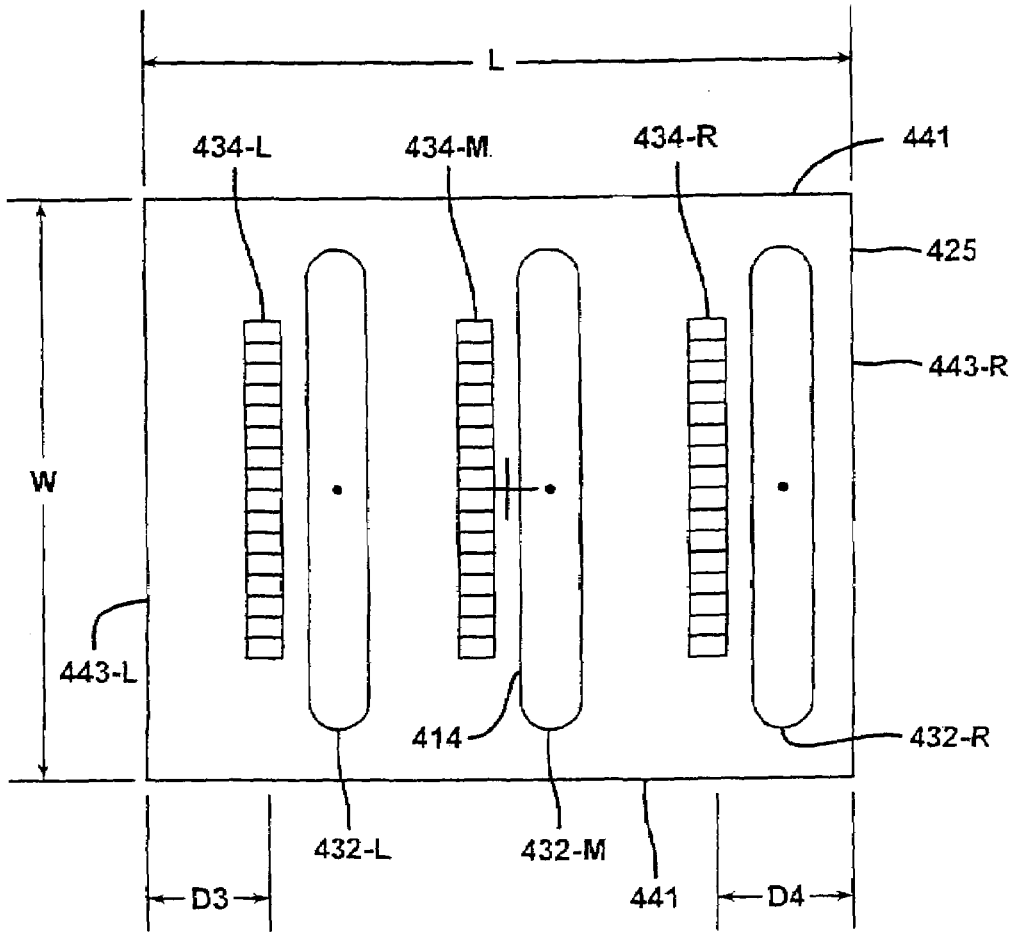
FIG. 4 is a diagrammatic view in accordance with the teachings of the present invention of a heater chip with a plurality of lengthwise asymmetrically arranged ink vias.

Appreciating that the ink vias of the rectangular heater chip can comprise other orientations that remain asymmetrical in the Reciprocating Direction but not in the widthwise direction, reference is now made to the heater chip 425 of FIG. 4 having lengthwise asymmetrical vias. In particular, a plurality of ink vias 432-L, 432-M, 432-R (left, middle, right as shown in the Figure) are disposed with their lengthwise extents generally parallel to the widthwise direction of the chip. Yet, none of the via centroids (•) coexist with the chip centroid (+). As shown, the two rightmost of the ink vias reside closer to the short end 443-R while the leftmost via resides closer to the other of the short ends 443-L. Simultaneously, however, all of the ink vias reside substantially equidistant to both of the long ends 441.

Preferably, the chip centroid (+) resides between a column 434-M of fluid firing elements and a longitudinal side 414 of the middle ink via 432-M. Preferred chip distances include a lengthwise distance of about 8 mm and a widthwise distance of about 5.1 mm. Alternatively, the lengthwise distance is shorter and is about 5.1 mm while the widthwise distance is about 8 mm. The leftmost column 434-L of fluid firing elements is about 1.2 mm (D3) from a short end periphery 443-L of the heater chip while the rightmost column 434-R of fluid firing elements is about 1 mm (D4) from the other short end periphery 443-R.

Figure 5C:
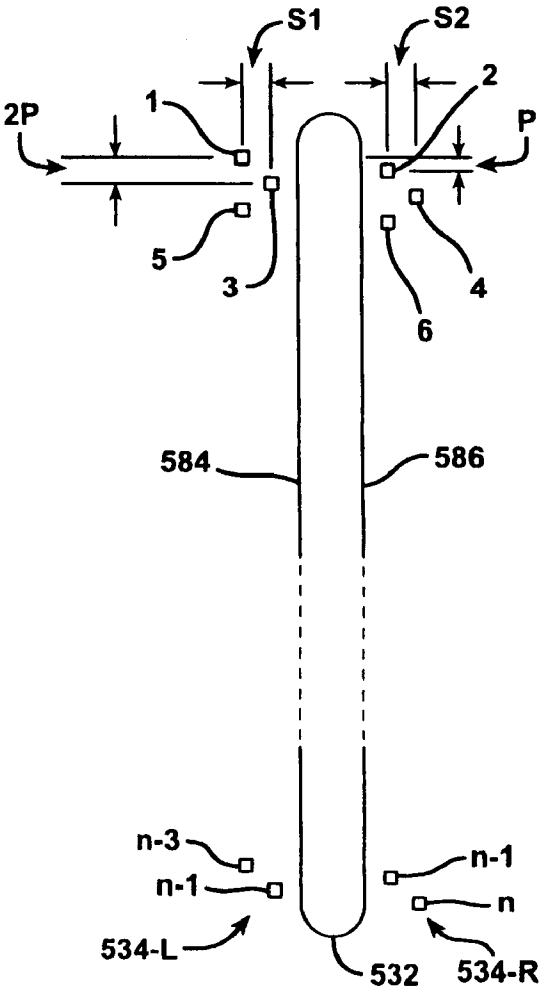
FIG. 5C is a diagrammatic view in accordance with the teachings of the present invention of a third embodiment of a plurality of fluid firing elements positioned about an asymmetric ink via.
Figure 5B:
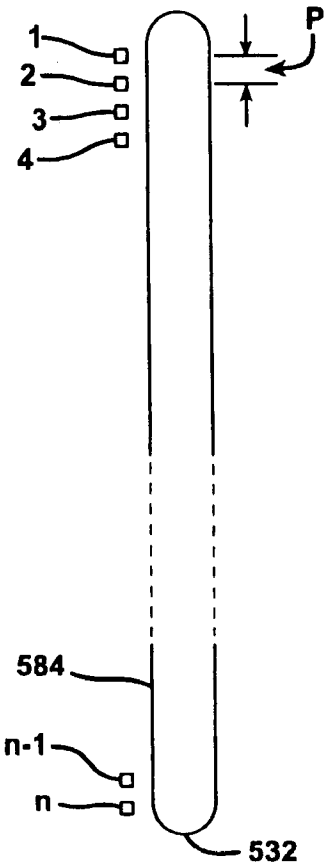
FIG. 5B is a diagrammatic view in accordance with the teachings of the present invention of a second embodiment of a plurality of fluid firing elements positioned about an asymmetric ink via.
Figure 5A:
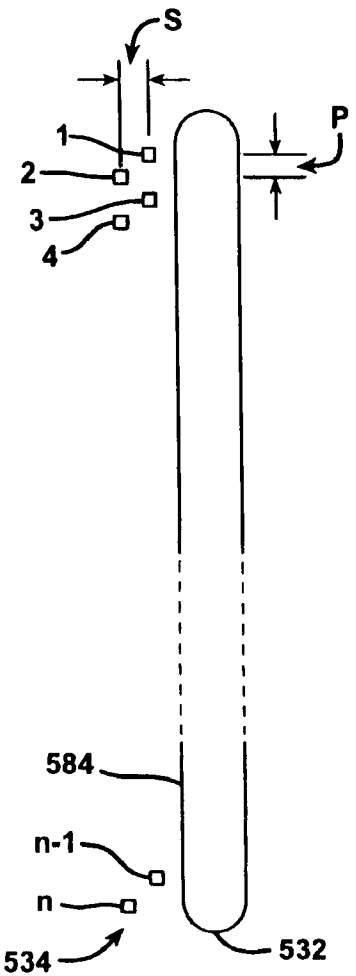
FIG. 5A is a diagrammatic view in accordance with the teachings of the present invention of a first embodiment of a plurality of fluid firing elements positioned about an asymmetric ink via.

With reference to FIGS. 5A–5C, those skilled in the art will appreciate that any given column of fluid firing elements will comprise a plurality of individual fluid firing elements representatively numbered 1 through n (FIGS. 5A, 5B) or numbered 1 through n-1 or 2 through n (FIG. 5C). In FIG. 5A, the fluid firing elements of a given column 534 exist exclusively along one side 584 of an ink via 532, having a longitudinal extent, and have a slight horizontal spacing gap S between vertically adjacent ones of fluid firing elements. In a preferred embodiment, the spacing gap S is about $3/1200^{th}$ of an inch. A vertical distance between vertically adjacent ones is the fluid firing element pitch and generally corresponds to the DPI of the printer in which they are used. Thus, preferred pitch includes, but is not limited to, $1/300^{th}$, $1/600^{th}$, $1/1200^{th}$, $1/2400^{th}$ of an inch.

In FIG. 5B, vertically adjacent ones of fluid firing elements are substantially linearly aligned with one another along an entirety of the length of the ink via. Although the fluid firing elements of FIGS. 5A, 5B have been shown exclusively on a left side of the via, they could easily exist on the right side. They could also embody a "column" despite a lack of linearity that has been depicted in the drawings.

In FIG. 5C, some of the ink vias of the heater chip may have more than one column of fluid firing elements and both may be disposed on the same side or on opposite sides of the ink via 532 in columns 534-L and 534-R. Each column may have a spacing gap S1, S2 between vertically adjacent ones of fluid firing elements or may not. Preferably, spacing gaps S1, S2 are substantially equal. Pitch P in this embodiment may be measured between sequentially numbered fluid firing elements such that a twice pitch 2P vertical spacing exists between sequential odd or even numbered fluid firing elements.

Figure 6:
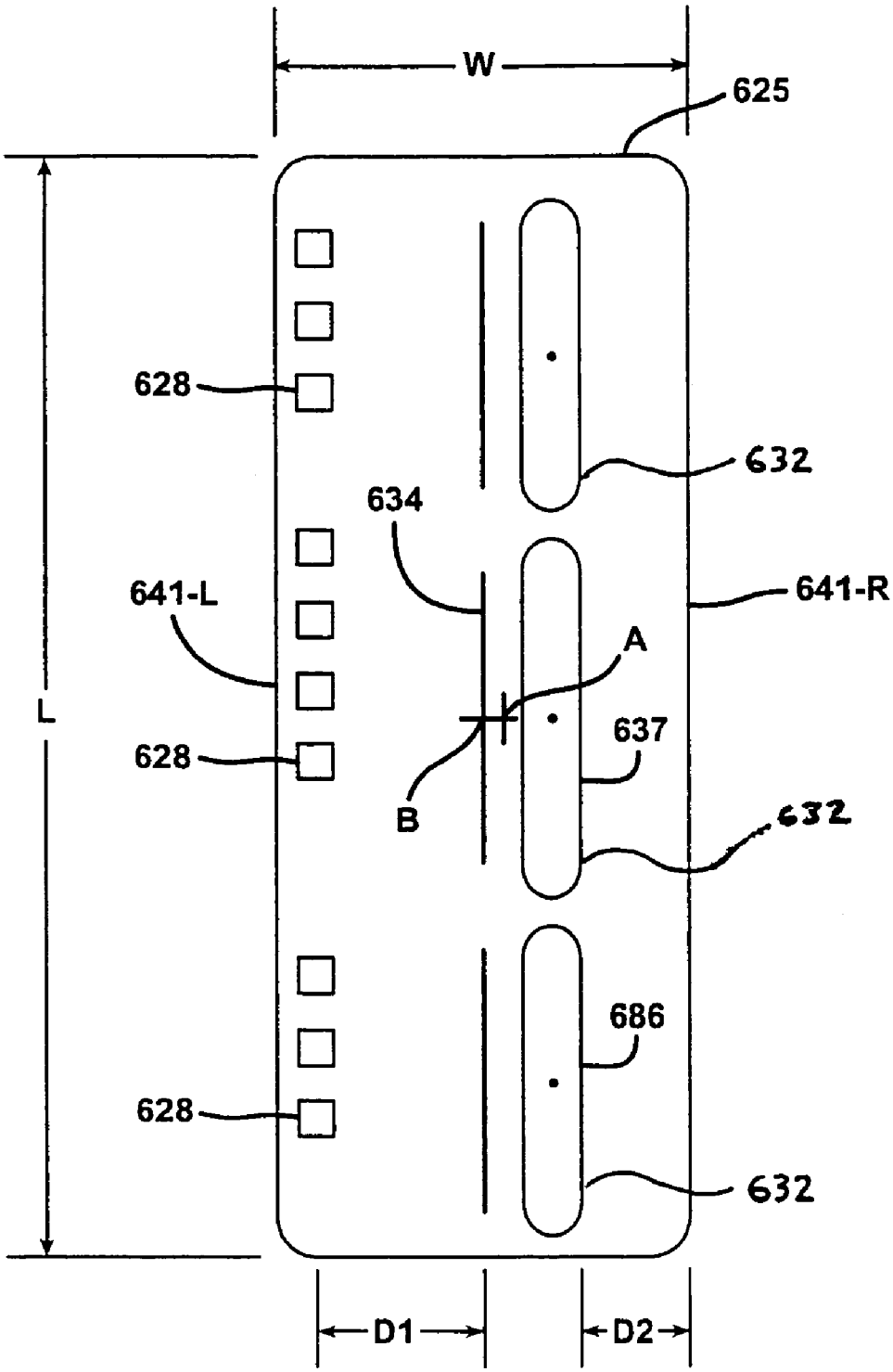
FIG. 6 is a diagrammatic view in accordance with the teachings of the present invention of a heater chip with a plurality of widthwise asymmetrically arranged ink vias.
Figure 7B:
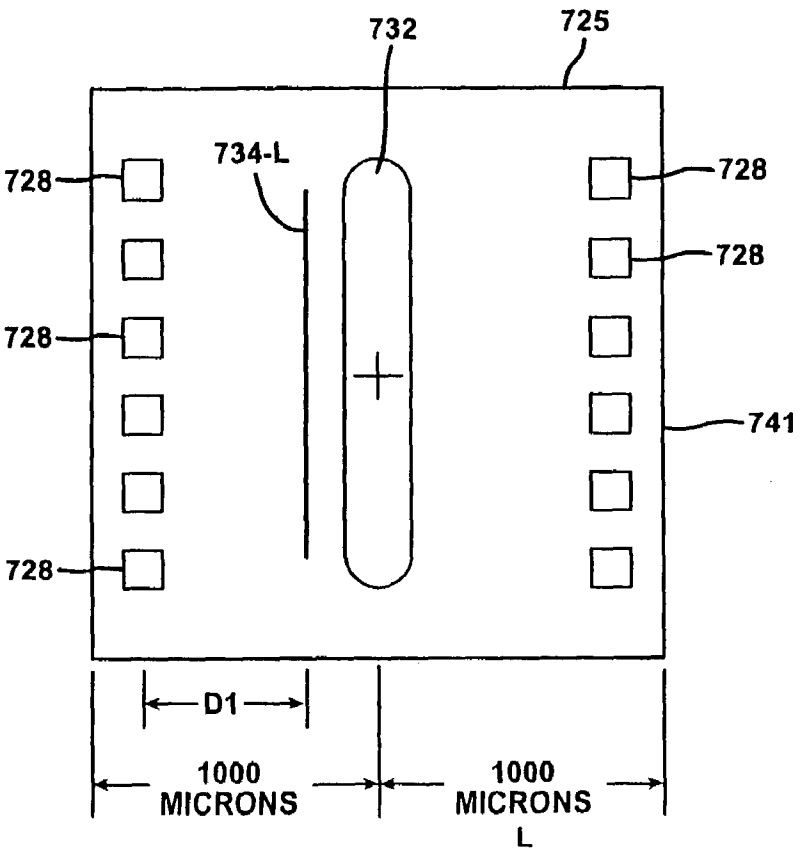
FIG. 7B PRIOR ART
FIG. 7B is a diagrammatic view in accordance with the prior art of an inkjet heater chip with a symmetrically disposed ink via and one corresponding column of heaters.
Figure 7A:
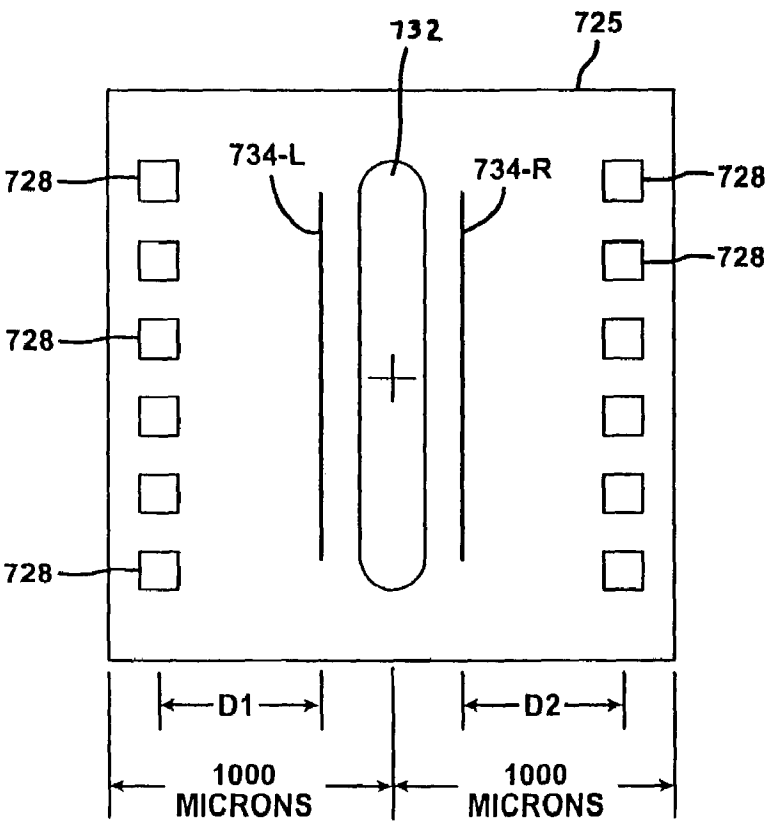
FIG. 7A PRIOR ART
FIG. 7A is a diagrammatic view in accordance with the prior art of an inkjet heater chip with a symmetrically disposed ink via and two corresponding columns of heaters.

In still another embodiment, as shown in FIG. 6, a heater chip 625 can have all pluralities of ink vias 632 disposed asymmetrically closer to a single end of the chip, such as long end 641-R. As before, asymmetry can also be described in terms of centroids and none of the ink via centroids (•) resides coincidentally with the chip centroid (+). In one embodiment, the chip centroid resides at position A between a column of fluid firing elements 634 (shown as a line) and a periphery 637 of the center ink via. In another embodiment, the column of fluid firing elements is centered in the Reciprocating Direction and the chip centroid (+) resides at position B.

For representative purposes only, the columnar disposed input terminals, bond pads 628, substantially parallel the columns of fluid firing elements and reside about 880 microns (d1) there from. A distance between one of the longitudinal sides 686 of an ink via and heater chip periphery 641-R is about 600 microns.

While the chip centroids shown in the previous figures all reside external to a boundary of any ink via, the present invention is not so limited to preclude the chip centroid from existing within a boundary of the ink via.

Still further, those skilled in the art will appreciate that the heater chips shown are the result of a substrate having been processed through a series of growth, deposition, masking, photolithography, and/or etching or other processing steps. As such, preferred deposition techniques include, but are not limited to, any variety of chemical vapor depositions (CVD), physical vapor depositions (PVD), epitaxy, evaporation, sputtering or other similarly known techniques. Preferred CVD techniques include low pressure (LP) ones, but could also include atmospheric pressure (AP), plasma enhanced (PE), high density plasma (HDP) or other. Preferred etching techniques include, but are not limited to, any variety of wet or dry etches, reactive ion etches, deep reactive ion etches, etc. Preferred photolithography steps include, but are not limited to, exposure to ultraviolet or x-ray light sources, or other, and photomasking includes photomasking islands and/or photomasking holes. The particular embodiment, island or hole, depends upon whether the configuration of the mask is a clear-field or dark-field mask as those terms as well understood in the art.

In a preferred embodiment, the substrate of the heater chip includes a silicon wafer of p-type, 100 orientation, having a resistivity of 5–20 ohm/cm. Its beginning thickness is preferably any one of 525+/−20 microns M1.5–89, 625+/−°microns M1.7–89, or 625+/−15 microns M1.13–90 with respective wafer diameters of 100+/−0.50 mm, 125+/−0.50 mm, and 150+/−0.50 mm.

Finally, the foregoing description is presented for purposes of illustration and description of the various aspects of the invention. The descriptions are not intended, however, to be exhaustive or to limit the invention to the precise form disclosed. Accordingly, the embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A heater chip for an inkjet printhead arranged for movement in a reciprocating direction in a printer that includes an advance direction relative to print media, comprising:

a chip centroid;

a column of fluid firing elements; and a sole ink via with two sides having a longitudinal extent, said column of fluid firing elements existing exclusively along one of said two sides and being substantially centered in said reciprocating and advance directions wherein a via centroid of said sole ink via is substantially offset from said chip centroid in a range of less than about 150 microns.

2. The heater chip of claim 1, wherein said chip centroid resides between said one of said two sides of said sole ink via and said column of fluid firing elements.

3. The heater chip of claim 1, wherein said chip centroid resides substantially within said column of fluid firing elements.

4. The heater chip of claim 1, wherein a distance between a periphery of said heater chip and said column of fluid firing elements is about 880 microns.

5. The heater chip of claim 1, wherein a distance between the other side of said two sides of said sole ink via and a periphery of said heater chip is about 600 microns.

6. A heater chip for an inkjet printhead that moves during use in a reciprocating direction relative to a print medium moving in an advance direction, comprising:

a column of fluid firing elements; and not more than one ink via, said not more than one ink via asymmetrically arranged in said reciprocating direction, said column of fluid firing elements existing exclusively along a single side of said not more than one ink via and being substantially centered in said reciprocating and advance directions.

7. The heater chip of claim 6, further including a column of input terminals, said column of fluid firing elements being about 880 microns from said column of input terminals.

8. The heater chip of claim 6, wherein said column of fluid firing elements has a spacing gap between vertically adjacent ones of said fluid firing elements.

9. A heater chip for an inkjet printhead that moves during use in a reciprocating direction substantially perpendicular to a media advance direction, comprising:

not more than one column of fluid firing elements, said not more than one column of fluid firing elements being substantially centered in said reciprocating and advance directions; and an ink via, said not more than one column of fluid firing elements existing exclusively along a single side of said ink via.

10. A heater chip for an inkjet printhead that moves during use in a reciprocating direction substantially perpendicular to a media advance direction comprising not more than one column of fluid firing elements, said not more than one column of fluid firing elements being substantially centered in said reciprocating and advance directions.

11. A heater chip for an inkjet printhead, comprising:

a thickness;

a chip centroid;

a plurality of columns of fluid firing elements each column being substantially parallel to one another;

a plurality of ink vias disposed through said thickness having two sides and a longitudinal extent, each said plurality of vias having a via centroid and no said via centroid coexisting with said chip centroid, at least one of said plurality of columns existing exclusively along one of said two sides; and a column of input terminals being substantially parallel to said plurality of columns of fluid firing elements.

12. An inkjet printhead, comprising:

a substantially rectangular heater chip having two long and short ends and at least three substantially parallel ink vias, two of said at least three substantially parallel ink vias being disposed closer to a same one of said two short ends while the other of said at least three substantially parallel ink vias being disposed closer to the other of said two short ends, all of said at least three substantially parallel ink vias being substantially equidistant to said two long ends.

13. An inkjet printhead, comprising:

a substantially rectangular heater chip having two long and short ends and at least three substantially parallel ink vias, said at least three substantially parallel ink vias being disposed closer to a same one of said two long ends.

14. The inkjet printhead of claim 13, further including a plurality of columns of fluid firing elements wherein one of said plurality of columns exists exclusively along one side of one via of said at least three substantially parallel ink vias.

15. The inkjet printhead of claim 13, wherein said substantially rectangular heater chip has a chip centroid existing beyond a boundary of any of said at least three substantially parallel ink vias.

16. An inkjet printhead, comprising:

a substantially rectangular heater chip having two long and short ends and not more than one ink via having a longitudinal extent substantially parallel to said two long ends, said not more than one ink via being disposed closer to one of said two long ends, wherein said substantially rectangular heater chip has a chip centroid and said not more than one ink via has a via centroid, said chip centroid and said via centroid not existing coextensively and being separated in a range of less than about 150 microns.

17. The inkjet printhead of claim 16, further including not more than one column of fluid firing elements exclusively existing along a single side of said not more than one ink via.

18. The inkjet printhead of claim 17, wherein said not more than one column of fluid firing elements passes through said chip centroid.

19. The inkjet printhead of claim 17, wherein said not more than one column of fluid firing elements includes a plurality of thermal resistive heater elements.

20. An inkjet printhead for an inkjet printer that moves during use in a reciprocating direction relative to a print medium that advances in an advance direction, comprising:

a supply of ink;

a flexible circuit supporting a plurality of I/O connectors and a plurality of electrical conductors; and a heater chip having a chip centroid and including a column of input terminals electrically connected to said pluralities of electrical conductors and I/O connectors;

a column of fluid firing elements about 880 microns from said column of input terminals operable to eject a drop of ink from said supply of ink upon receipt of a firing signal from one input terminal of said column of input terminals; and not more than one ink via having a via centroid not coextensively arranged with said chip centroid, said not more than one ink via having two sides and a longitudinal extent substantially parallel to said advance direction asymmetrically arranged in said reciprocating direction, said column of fluid firing elements existing exclusively along one of said two sides, the other of said two sides existing about 600 microns from a periphery of said heater chip.

21. A heater chip having a widthwise and lengthwise direction for an inkjet printhead, comprising:

a chip centroid;

a column of fluid firing elements; and not more than one ink via with two sides having a longitudinal extent, said column of fluid firing elements existing exclusively along one of said two sides and being substantially centered in both said widthwise and lengthwise directions wherein a via centroid of said not more than one ink via does not coexist with said chip centroid and is separated in a substantially straight line range of about 150 microns or less.

* * * * *